US006556070B2

(12) United States Patent
Paulus

(10) Patent No.: US 6,556,070 B2
(45) Date of Patent: Apr. 29, 2003

(54) CURRENT SOURCE THAT HAS A HIGH OUTPUT IMPEDANCE AND THAT CAN BE USED WITH LOW OPERATING VOLTAGES

(75) Inventor: Christian Paulus, Münich (DE)

(73) Assignee: Infineon Technologies AG, München (DE)

( * ) Notice: Subject to any disclaimer, the term of this patent is extended or adjusted under 35 U.S.C. 154(b) by 0 days.

(21) Appl. No.: 10/082,337

(22) Filed: Feb. 25, 2002

(65) Prior Publication Data

US 2002/0113641 A1 Aug. 22, 2002

Related U.S. Application Data

(63) Continuation of application No. PCT/DE00/02937, filed on Aug. 24, 2000.

(30) Foreign Application Priority Data

Aug. 25, 1999 (DE) ..... 199 40 382

(51) Int. Cl.[7] ..... G05F 1/10

(52) U.S. Cl. ..... 327/543; 327/538; 327/541; 323/513

(58) Field of Search ..... 327/538, 540, 327/541, 543; 323/312, 313, 315

(56) References Cited

U.S. PATENT DOCUMENTS

| | | | | | |
|---|---|---|---|---|---|
| 4,051,392 | A | | 9/1977 | Rosenthal et al. | 327/543 |
| RE29,910 | E | * | 2/1979 | Ahmed | 323/315 |
| 4,342,926 | A | * | 8/1982 | Whatley | 323/315 |
| 4,471,292 | A | | 9/1984 | Schenck et al. | 323/315 |
| 5,045,773 | A | * | 9/1991 | Westwick et al. | 323/315 |
| 5,306,964 | A | | 4/1994 | Taylor | |
| 5,307,007 | A | * | 4/1994 | Wu et al. | 323/313 |
| 5,469,104 | A | | 11/1995 | Smith et al. | 327/541 |
| 5,488,328 | A | | 1/1996 | Ludwig et al. | 327/538 |
| 5,680,037 | A | * | 10/1997 | Carobolante | 271/105 |
| 5,949,278 | A | * | 9/1999 | Oguey | 323/315 |
| 6,188,211 | B1 | * | 2/2001 | Rincon-Mora et al. | 323/273 |

FOREIGN PATENT DOCUMENTS

DE 43 15 299 C1 6/1994

* cited by examiner

*Primary Examiner*—Terry D. Cunningham
(74) *Attorney, Agent, or Firm*—Laurence A. Greenberg; Werner H. Stemer; Ralph E. Locher

(57) ABSTRACT

An electrical current source with a high output resistance has a current determining transistor and a regulating switch. The regulating switch has an amplifier circuit with transistors and a regulating transistor, and allows the electrical supply to have a high output resistance. To enable the electrical supply to be used at even very low operating voltages, a sourcing circuit is provided, which is used for setting a freely selectable minimal decrease in voltage over the supply. The sourcing circuit has one or more transistors and influences the voltage at the current determining transistor. The output resistance of the electrical source can be further improved by utilizing a correcting circuit that has resistors.

10 Claims, 3 Drawing Sheets

CURRENT SOURCE THAT HAS A HIGH OUTPUT IMPEDANCE AND THAT CAN BE USED WITH LOW OPERATING VOLTAGES

CROSS-REFERENCE TO RELATED APPLICATION

This application is a continuation of copending International Application No. PCT/DE00/02937, filed Aug. 24, 2000, which designated the United States.

BACKGROUND OF THE INVENTION

Field of the Invention

The invention relates to a high output impedance current source including a transistor that determines the output current and a control circuit for the current-determining transistor.

Developments in CMOS (Complementary Metal Oxide Semiconductor) process technology mean that the basic circuits in analog circuit engineering demand new solutions that meet strict requirements of linearity and bandwidth, for instance, despite changes in transistor properties and falling operating voltages.

Current sources can be used, for instance, as basic modules for current mirror circuits. Current mirroring generally involves a circuit arrangement in which a copy of the input current is provided at the output. The purpose of a current mirror is thus to duplicate and/or respectively amplify or attenuate an input current and to output it at the output node(s). The simplest current mirror consists of two identical transistors.

Such simple current mirrors have the drawback of a relatively low output impedance, however, and are therefore unsuitable for many applications. The current through a MOS (Metal Oxide Semiconductor) transistor is determined both by the potential at the gate terminal and by the voltage drop across the source-drain channel.

In order to obtain a high output impedance, cascoded current sources are therefore used for example. In such a current source, the source-drain channels of at least two MOS transistors are connected in series, and each of the gate terminals are set at a fixed potential. By this measure, the drain-source voltage across the current-determining transistor is decoupled from voltage changes at the output node, and the output impedance is thus increased. The disadvantage of such cascoded current mirrors lies in the fact that there must be a relatively high minimum voltage between the output node and the operating voltage terminal in order to continue to achieve the specified output impedance. If the voltage falls below this, then the MOS transistors are no longer operating in saturation mode and the output impedance of the current source drops drastically. This minimum voltage drop essentially determines how fit the current source is for use with low operating voltages.

The regulated cascode current source on which the present invention is based is an improved version of this cascoded current source. Such a current source, whose design and operation is explained in more detail in connection with FIG. 1, enables the drain-source voltage across the current-determining transistor to remain constant. By this measure, the voltage drop across this current source can be reduced to a relatively small value, where the lower limit of this voltage drop is given by the threshold voltage of one of the transistors in the control loop. The high gain in the control loop means that the current source has a high output impedance.

The circuit works on the principle that the minimum voltage drop across the current source cannot fall below the threshold voltage mentioned above. This can be problematic with extremely low operating voltages.

SUMMARY OF THE INVENTION

It is accordingly an object of the invention to provide a current source which overcomes the above-mentioned disadvantages of the prior art apparatus of this general type.

In particular, it is an object of the invention to provide a current source of the type mentioned in the introduction that has a high output impedance and that can be used at very low operating voltages.

With the foregoing and other objects in view there is provided, in accordance with the invention, a current source having a high output impedance that includes: a current-determining transistor that determines an output current; a source-follower circuit providing an output signal; a control circuit having an input receiving the output signal of the source-follower circuit; and a control transistor connected in series with the current-determining transistor. A potential is defined between the current-defining transistor and the control transistor. The current-determining transistor has a source-drain voltage. The control circuit ensures that the source-drain voltage of the current-determining transistor has and maintains a required value by applying a suitable drive to the control transistor. The source-follower circuit has an input that receives the potential between the current-defining transistor and the control transistor.

In accordance with an added feature of the invention, the source-follower circuit includes at least one transistor.

In accordance with an additional feature of the invention, the source-follower circuit includes a plurality of transistors.

In accordance with another feature of the invention, at least one of the plurality of the transistors is embodied as a current source.

In accordance with a further feature of the invention, the control circuit includes an amplifier circuit having at least one transistor.

In accordance with a further added feature of the invention, the control circuit includes at least one control transistor.

In accordance with a further additional feature of the invention, a correcting element is provided for the current-determining transistor.

In accordance with yet an added feature of the invention, the correcting element includes at least one transistor.

In accordance with yet an additional feature of the invention, the correcting element includes two transistors.

The object of the invention is obtained by a current source having a high output impedance that includes a transistor for determining the output current and a control circuit for the current-determining transistor. In order to set a low, freely selectable minimum voltage drop across the current source, the current source is provided with a source-follower circuit that affects the voltage across the source-drain channel of the current-determining transistor.

This creates a current source that is distinguished by a high output impedance and that is particularly suitable for use with low operating voltages.

The invention is based on the fundamental idea that a high output impedance can be achieved by a current-source circuit designed in the form of a regulated cascode current source, as has already been described above. The regulated cascode current source first includes at least one transistor that determines the output current, whose gate potential Vin can be used to set the useful current. A suitable control circuit is used to maintain a constant voltage Vds across the drain-source channel of this transistor, and hence ensures that the current flowing through the current-determining transistor is not dependent on the potential at the output node of the current source. Such a control circuit is explained in more detail later in the description.

A source-follower circuit has also been provided in order to solve the problem, described with reference to the state of the art for the regulated cascode current source, which is that the minimum voltage drop cannot be reduced below a certain limit.

Source-follower circuits are known in the art, and a basic circuit involves at least one field effect transistor. Advantageous embodiments of source-follower circuits are explained in more detail in the subsequent description, but without restricting the invention to the cited examples.

By using such a source-follower circuit in the regulated cascode current source, the voltage drop across the current-determining transistor can be set to any value, and thus the minimum voltage drop across the current source can be reduced. In this way, very wideband current sources with high output impedance can be realized even in low-voltage applications.

Preferably the source-follower circuit can contain at least one, but preferably two or more transistors. In its simplest design the circuit can have only a single transistor. It is also conceivable, however, that the circuit can have a far more complex design according to the requirement and application. In this case the number of transistors may be correspondingly greater. The invention is not limited to a specific number of transistors. In one advantageous embodiment the source-follower circuit contains two transistors.

At least one of the transistors can advantageously be designed to act as a current source.

In a further embodiment the control circuit can contain an amplifier circuit. This amplifier circuit preferably has one or more transistors, where the number of transistors can vary according to the properties required of the current source.

In addition, the control circuit can contain at least one control transistor.

A correcting element can advantageously be provided for the current-carrying transistor.

This correcting element can, for example, contain one or more transistors. In an advantageous embodiment, the correcting element can contain two transistors.

In the inventively designed current source, the case can arise that the current-determining transistor is no longer operating in saturation mode if the voltage drop across it is reduced too far. This has the effect that the output current may fluctuate when the potential at the output node fluctuates, and thus the output impedance is reduced. This problem can be countered using the correcting element, which increases the output impedance significantly. An example of this is explained in the following description of the figures.

Other features which are considered as characteristic for the invention are set forth in the appended claims.

Although the invention is illustrated and described herein as embodied in a current source that has a high output impedance and that can be used with low operating voltages, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
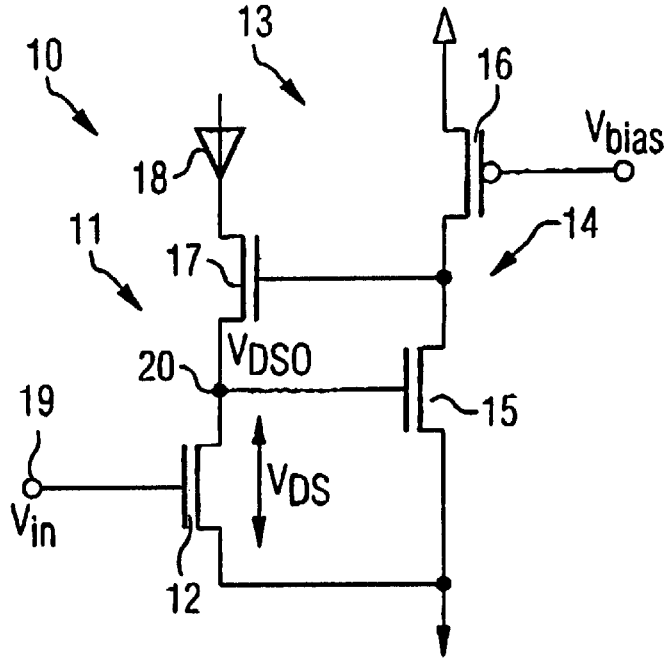
FIG 1 ( Prior Art )
FIG. 1 shows a prior art regulated cascode current source circuit.

Referring now to the figures of the drawing in detail and first, particularly, to FIG. 1 thereof, there is shown a prior art current source 10. The current source 10 is designed as a regulated cascode current source circuit. In the cascode current source circuit 10, the useful current at the output node 18 is set by the input voltage Vin at the input node 19. The current intensity is essentially determined by the dimensional design and the process-defined properties of the transistor 12.

In addition, a control circuit 13 is provided that includes an amplifier circuit 14 and a control transistor 17. The amplifier circuit 14 itself contains two transistors 15, 16. The result of using the control circuit 13 together with a suitable dimensioning of the transistors 15, 16, 17, is that the voltage Vds, which drops across the source-drain channel of the current-determining transistor 12, is constant, and hence the current through the current-determining transistor 12 is not dependent on the potential at the output node 20. This is achieved by the amplifier circuit 14 providing suitable correction of the gate potential of the transistor 17.

A current source 10 having high output impedance can be realized by the circuit arrangement of FIG. 1.

It is also possible to use the current source 10 down to a relatively low voltage drop compared with other known current sources. The lower limit for this minimum possible voltage is determined by the transistor 15. It is made up of the saturation voltage Vsat15 and the threshold voltage Vth15 for the transistor 15. The minimum possible voltage drop must accordingly always be greater than the sum of Vsat15+Vth15, but at least as great as the threshold voltage Vth15. For this reason it is not possible to use the current source 10 for a minimum voltage drop that is less than this threshold voltage Vth15.

Figure 2:
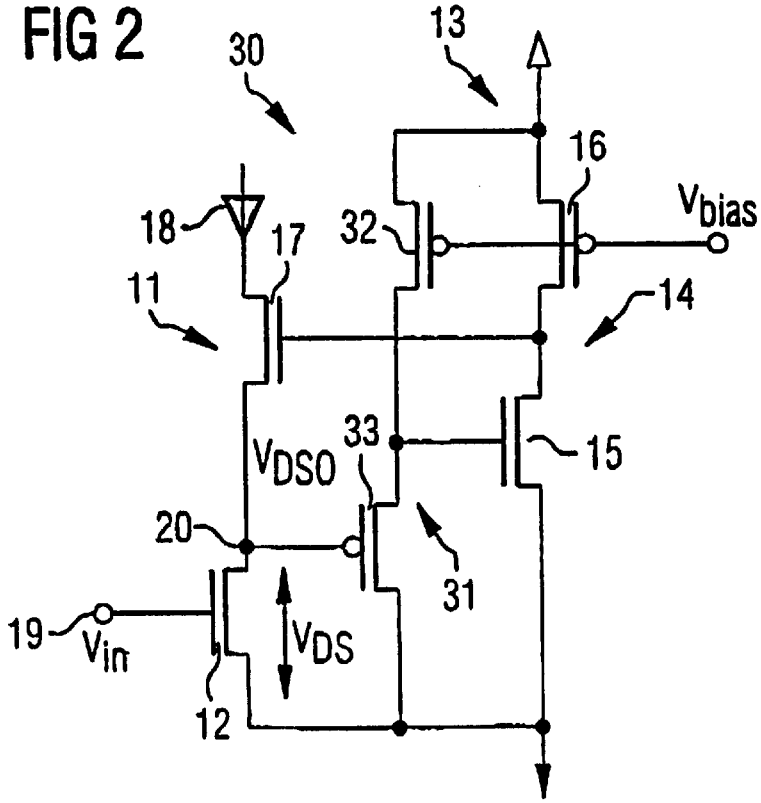
FIG. 2 shows a first embodiment of a circuit configuration operating as a current source.
Figure 3:
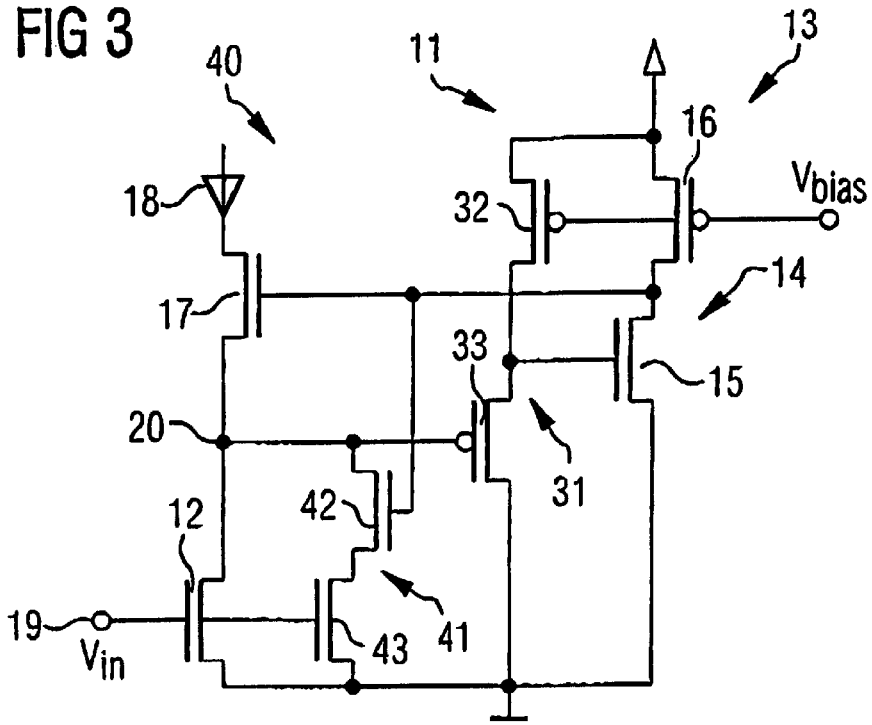
FIG. 3 shows a second embodiment of a circuit configuration operating as a current source.

Now turning to the invention, the current sources 30, 40 shown in FIGS. 2 and 3 are inventively designed so that very high output impedances can be realized with a very low voltage drop.

The basic structure of the current source 30 of FIG. 2 corresponds to the current source 10 of FIG. 1, and therefore elements of identical construction have been given the same reference numbers, and these elements will not be described again in order to avoid repetition. Full reference is made to the above descriptions relating to FIG. 1, and attention is hereby drawn to these descriptions.

Unlike the current source 10 shown in FIG. 1, the current source 30 shown in FIG. 2 additionally contains a source-follower circuit 31, which in this case is composed of two transistors 32, 33. Transistor 32 acts here as current source.

The potential Vds across the source-drain channel of the current-determining transistor 12 is shifted, preferably lowered, with respect to the input of the amplifier 14, by using the source-follower circuit 31. The reason for this is that the voltage Vds that drops across transistor 12 is obtained from a subtraction of the gate-source voltage of the transistor 15 and the voltage drop across the gate-source terminals of transistor 33. Both voltages are composed of a transistor-specific threshold voltage and a saturation voltage. Whilst the threshold voltage constitutes a process-dependent parameter, the saturation voltages can be selected as required by the dimensional design of the transistors. Consequently, the voltage Vds across the current-determining transistor 12 can also be suitably selected. Using the source-follower circuit 31, this voltage, and hence the minimum voltage drop across the current source, can theoretically be reduced to zero, but can be at least significantly reduced in comparison with the current source 10 of FIG. 1.

Thus the current source 30 can be operated down to a minimum output voltage that is independent of the threshold voltage Vth15 of the transistor 15, and that is defined as required. Since all of the transistors are in saturation, rapid and precise regulation is possible, so that high output impedances can be achieved.

If the source-drain voltage Vds across transistor 12 as described in FIG. 2 is reduced, this transistor can come out of saturation, which means that small variations in the voltage Vds of the transistor 12 cause stronger fluctuations in the output current and hence the output impedance is reduced.

This situation can be countered by a suitable correcting element 41 as depicted in FIG. 3. FIG. 3 shows a current source 40, which essentially has the same design as the design of the current source 30 shown in FIG. 2. For this reason elements of identical construction are given the same reference numbers. In order to avoid repetition, full reference is made to the descriptions relating to FIG. 2, and attention is hereby drawn to these descriptions.

The current source 40 of FIG. 3 includes an additional element when compared with the current source 30 shown in FIG. 2. The additional element is a correcting element 41 that includes two transistors 42 and 43. The correcting element 41 adds a correcting current to the output current. The correcting current is dependent, via the control voltage of transistor 17, on the voltage drop across the current source. If the voltage at the output node 18 drops, the control loop will increase the gate potential at the control transistor 17 in order to keep the voltage at the node 20 largely constant. This gate potential is also used to drive transistor 42 that determines the size of the correcting current. Thus, the correcting current increases as the voltage drop across the current source falls, and hence increases the output impedance of the current source. In theory a current source with a negative output impedance is also feasible in this way by forcing overcompensation.

Figure 4:
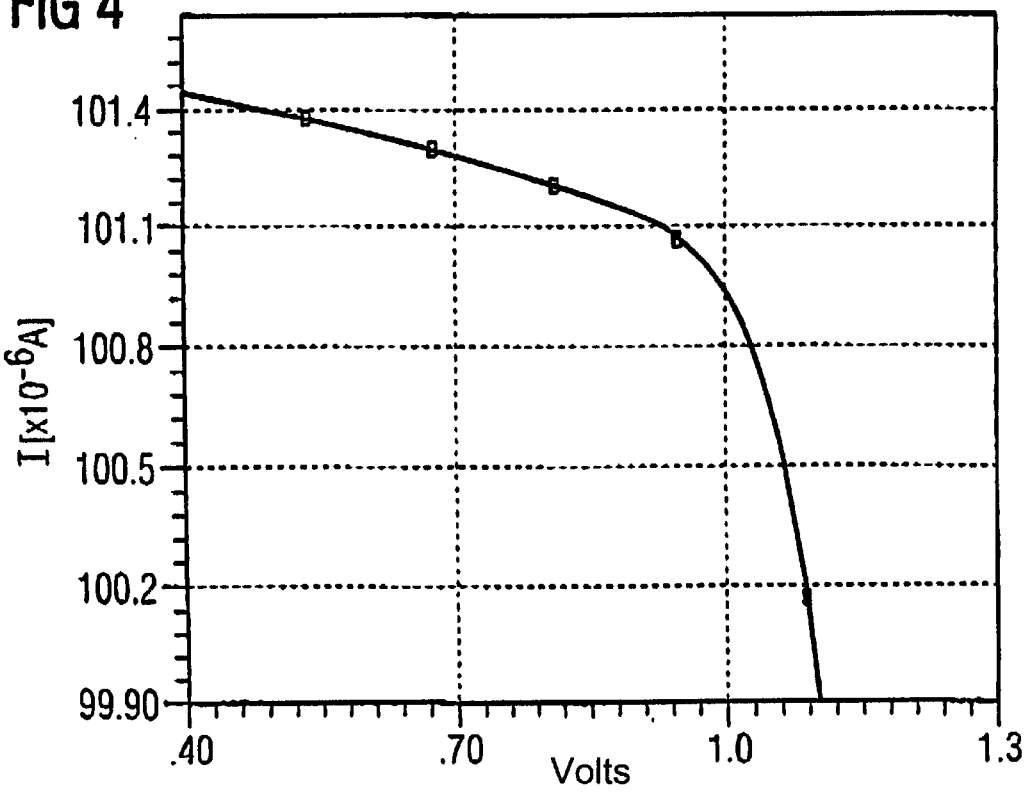
FIG. 4 is a diagram showing the output current as a function of the voltage drop across the current source in the circuit configuration shown in FIG. 2.
Figure 5:
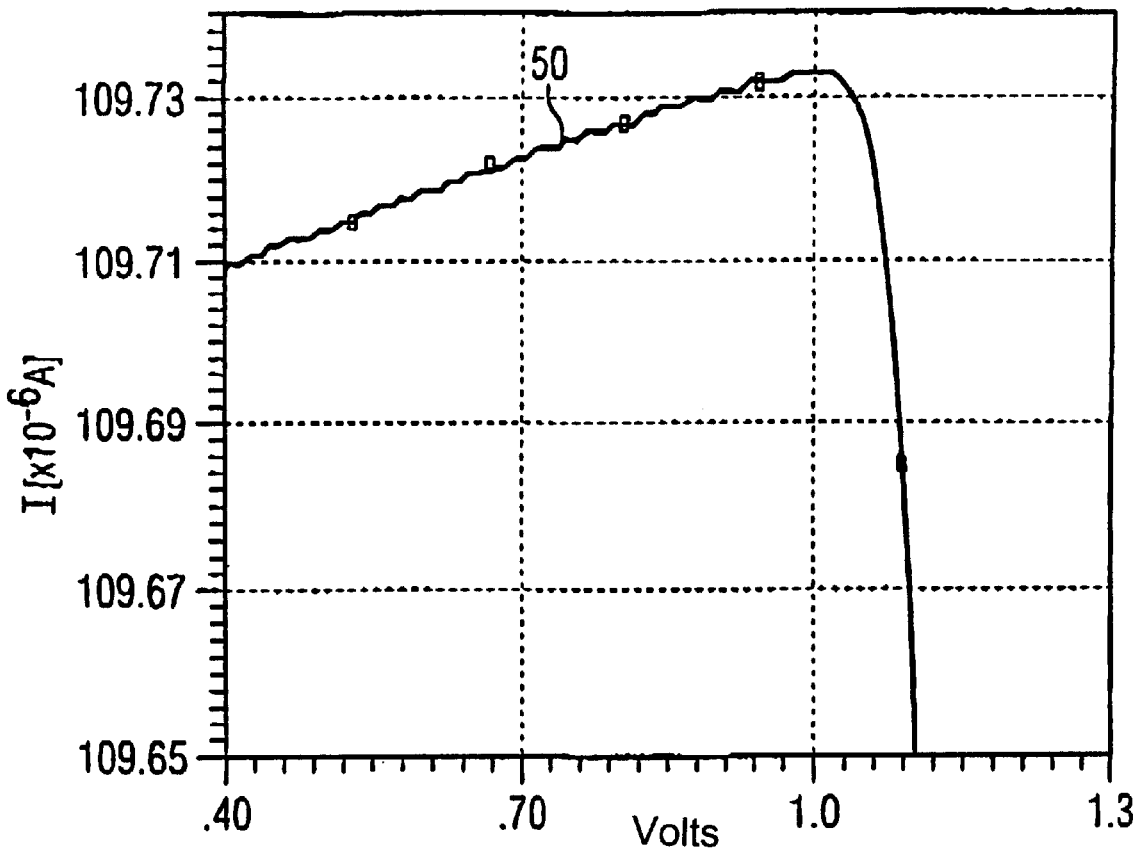
FIG. 5 is a diagram showing the output current for the circuit configuration with the correcting element shown in FIG. 3.

FIGS. 4 and 5 respectively show the results that were obtained in simulations of the current sources designed as shown in FIGS. 2 and 3. The diagrams show the output current of the constant current source as a function of the voltage drop across the current source, i.e. in this case the potential difference between Vss and the output node 18.

FIG. 4 shows the output current of the current source 30, without correcting element, as a function of the voltage drop across the current source. The diagram illustrates the weak dependence of the output current on the falling voltage, and hence the high output impedance of the current source. The current drops sharply if the voltage falls below about 400 mV. This voltage represents the minimum voltage drop across the current source, and by employing the source-follower circuit 31, it lies below the threshold voltage of the transistors used, which equals about 500 mV.

The curve 50 in FIG. 5 shows the output current of the current source 40 with the correcting element 41. The transistors have exactly the same dimensional design as that used to generate the curve shown in FIG. 4. The output current displayed equals the sum of the current of transistor 12 and the current through the transistors 42 and 43.

It shows that the dependence of the output current on the voltage drop has been significantly reduced, and hence the output impedance increased, in comparison with the solution without the correcting element. The minimum voltage drop across the current source of about 400 mV is not affected by the correcting element.

I claim:

1. A current source having a high output impedance at an output terminal, comprising:

a current-determining transistor determining an output current, said current-determining transistor having a source terminal, a drain terminal, a gate terminal, and a source-drain voltage;

a source-follower circuit providing an output signal;

a control circuit having:

an output terminal; and an input connected to said source-follower circuit and receiving said output signal of said source-follower circuit;

a control transistor connected in series with said current-determining transistor, said control transistor having a source terminal, a drain terminal, and a gate terminal;

one of said source terminal and said drain terminal of said current-determining transistor being connected with one of said source terminal and said drain terminal of said control transistor and another one of said source terminal and said drain terminal of said current-determining transistor being connected with a pole of a voltage supply;

an input voltage supplied to said gate terminal of said current-determining transistor for determining a current output by the current source;

one of said source terminal and said drain terminal of said control transistor being connected with one of said source terminal and said drain terminal of said current-determining transistor and another one of said source terminal and said drain terminal of said control transistor being the output terminal of the current source from which output current is generated by the current source;

a node between said current-determining transistor and said control transistor defining a potential;

said gate terminal of said control transistor being connected with said output terminal of said control circuit;

said control circuit ensuring that said source-drain voltage of said current-determining transistor has and maintains a required value by applying a suitable drive to said control transistor; and said source-follower circuit having an input receiving said potential between said current-defining transistor and said control transistor.

2. The current source according to claim 1, wherein said source-follower circuit includes at least one transistor.

3. The current source according to claim 1, wherein said source-follower circuit includes a plurality of transistors.

4. The current source according to claim 3, wherein at least one of said plurality of said transistors is embodied as a current source.

5. The current source according to claim 1, wherein said control circuit includes an amplifier circuit having at least one transistor.

6. The current source according to claim 1, wherein said control circuit includes at least one control transistor.

7. The current source according to claim 1, including a correcting element operatively connected with one of said source terminal and said drain terminal of said current-determining transistor.

8. The current source according to claim 7, wherein said correcting element includes at least one transistor.

9. The current source according to claim 7, wherein said correcting element includes two transistors.

10. The current source according to claim 1, wherein said input voltage is supplied only to said gate terminal of said current-determining transistor.

* * * * *

UNITED STATES PATENT AND TRADEMARK OFFICE

CERTIFICATE OF CORRECTION

PATENT NO. : 6,556,070 B2
DATED : April 29, 2003
INVENTOR(S) : Christian Paulus

It is certified that error appears in the above-identified patent and that said Letters Patent is hereby corrected as shown below:

Title page,
Item [75], Inventor should read as follows:
-- Christian Paulus, München (DE) --

Signed and Sealed this

Twenty-eighth Day of October, 2003

JAMES E. ROGAN
*Director of the United States Patent and Trademark Office*